US007019716B2

(12) United States Patent
Tsai et al.

(10) Patent No.: US 7,019,716 B2
(45) Date of Patent: Mar. 28, 2006

(54) DRIVING METHOD FOR PDPS WITH VARIABLE VERTICAL FREQUENCY

(75) Inventors: Chung-Kuang Tsai, Hsinchu (TW); Li-Ru Lyu, Jubei (TW)

(73) Assignee: AU Optronics Corp., Hsinchu (TW)

( * ) Notice: Subject to any disclaimer, the term of this patent is extended or adjusted under 35 U.S.C. 154(b) by 342 days.

(21) Appl. No.: 10/429,992

(22) Filed: May 5, 2003

(65) Prior Publication Data

US 2003/0206186 A1 Nov. 6, 2003

(30) Foreign Application Priority Data

May 6, 2002 (TW) ..... 91109361 A

(51) Int. Cl.
*G09G 3/28* (2006.01)

(52) U.S. Cl. ..... 345/63; 345/60

(58) Field of Classification Search ..... 345/60–63, 345/68, 211–213, 690

See application file for complete search history.

(56) References Cited

U.S. PATENT DOCUMENTS

| | | | | |
|---|---|---|---|---|
| 6,037,917 | A * | 3/2000 | Kawakami | 345/63 |
| 6,243,073 | B1 * | 6/2001 | Kawamura et al. | 345/690 |
| 6,268,890 | B1 | 7/2001 | Kawahara | 348/739 |
| 6,269,268 | B1 | 7/2001 | Callaghan et al. | 607/26 |
| 6,747,616 | B1 * | 6/2004 | Honda et al. | 345/63 |

* cited by examiner

*Primary Examiner*—Regina Liang
*Assistant Examiner*—Duc Q. Dinh
(74) *Attorney, Agent, or Firm*—Ladas & Parry LLP

(57) ABSTRACT

A driving method for PDPs with variable vertical frequency. The method increases the sum of the sustain periods to obtain high brightness, by adjusting vertical frequency of a PDP through an image loading such that each image frame time displayed on the PDP is adjusted. The inventive driving method also adjusts total sustain pulses in the PDP through the image loading. To comply with the driving method, a driving apparatus is further provided to achieve the high brightness.

13 Claims, 8 Drawing Sheets

| | Nos. | units |
|---|---|---|
| Subfield No. | 10 | unit |
| Total Sustain No. | 615 | unit |
| Peak Brightness | 530 | nits |
| Average Peak Brightness for one Pulse | 0.8618 | nits/unit |
| Vertical Freg for an input frame | 60 | Hz |
| Display Time for the input frame | 16.6667 | ms |
| New Vertical Frequency | 43 | Hz |
| New Display Time | 23.2558 | ms |
| Excess Time | 6.5891 | ms |
| Time for one pulse | 6 | $\mu$s |
| Excess Total Sustain No. | 1098 | unit |
| Excess Peak Brightness | 946.4087 | nits/frame |
| New Peak Brightness | 1497.409 | nits/frame |
| Average Peak Brightness | 1058.093 | nits |

FIG. 3

DRIVING METHOD FOR PDPS WITH VARIABLE VERTICAL FREQUENCY

BACKGROUND OF THE INVENTION

1. Field of the Invention

The invention relates to a driving method and apparatus for plasma display panels (PDP) with variable vertical frequency, more particularly to a driving method and apparatus for increasing sustain period in PDPs to gain high brightness.

2. Description of the Related Art

According to current driving method for PDPs, a frame includes several subfields to complete an image display. To represent 256 gray scales, for example, 8 subfields can be used to complete an image display in a predetermined order, as shown in FIG. 1. A complete frame contains 8 subfields sequentially from SF1 to SF8, each consisting of reset period (R1~R8), address period (A1~A8) and sustain period (S1~S8). In the reset period, residual charges of previous frame and a certain number of wall charges in every display cell are reset. In the address period, wall charges are accumulated in display cells to be activated (in "on" state) through address discharge. In the sustain period, display is continued by sustaining discharges in the cells to be activated. In the reset periods R1~R8 and the sustain periods S1~S8, display cells of a PDP are concurrently processed, whereas in the address periods A1~A8, display cells on a scan line are sequentially processed, line by line. Display brightness is positive in proportion to the lengths of the sustain periods S1~S8. In this case, the length of the sustain periods S1~S8 in the subfields SF1–SF8 are proportionally weighted to values 1:2:4:8:16:32:64:128 that indicate required numbers for sustaining discharge cycle to represent 256 gray scales.

When duration of the sustain period is increased, PDPs show a higher brightness. Accordingly, if the sum of the sustain periods in a frame of a PDP is represented by ΣTsustain , a reset action in one subfield of the frame is set to Tr, a write action in one scan line of the subfield is set to Ts, the number of scan lines of the frame is set to Ns, and each frame of the PDP has the number Nsf of subfields, the display time for one frame of the PDP T (=1/vertical frequency of the PDP) can be represented by:

$$T=(Tr+Ts*Ns)*Nsf+\Sigma T\text{sustain}.$$

To obtain high brightness for current PDPs by means of the ΣTsustain increase, two methods are adopted:

1. The number of subfields for one frame is changed, i.e., changing Nsf such that high brightness is obtained by adjusting subfield number and total sustain pulses in the PDP through image loading change. However, this way causes poor image quality due to fewer subfields in high brightness.

2. The number of scan lines is changed, i.e., changing Ns to increase total sustain pulses in the PDP such that high brightness is obtained due to increased total sustain pulses in the PDP. However, this way causes poor image quality for low gray-scaled frame display.

SUMMARY OF THE INVENTION

Accordingly, it is an object of the present invention to provide a driving method for plasma display panels (PDPs) with variable vertical frequency, which increases the sum of the sustain periods to obtain high brightness. The inventive driving method adjusts vertical frequency of a PDP through an image load such that each image frame time displayed on the PDP is adjusted. The inventive driving method also adjusts total sustain pulses in the PDP through the image loading. The inventive method accordingly increases the sum of the sustain periods to obtain high brightness without the disadvantages in the aforementioned prior art.

To achieve the aims, the present invention provides a first driving method for PDPs with variable vertical frequency, suitable for a PDP with a vertical frequency, and a total of sustain pulses and multiple subfields, and each subfield containing a cycle number required for sustaining discharge. The inventive driving method includes inputting an input frame to the PDP and accordingly calculating an image loading value to change the vertical frequency to a new vertical frequency and to change the total of sustain pulses to a new total of sustain pulses, re-implementing the cycle number for each subfield according to the new vertical frequency, and displaying an output frame on the PDP according to the new vertical frequency, the new total of sustain pulses and the subfields.

To comply with the first driving method, the invention provides a driving apparatus for PDPs with variable vertical frequency. The driving apparatus is connected to a PDP with a total of sustain pulses and multiple subfields, each subfield containing a cycle number required for sustaining discharge. The driving apparatus includes an input device to receive an input frame with an input frequency, a measurement device connected to the input device, to measure an image loading value from the input frame and output the image loading value, a conversion device connected to the input device and the measurement device, to receive the input frame with the input frequency and convert the input frame to an image frame with an output frequency for outputting the image frame, wherein the output frequency is a function of image loading, and a first display control device connected to the conversion device and the measurement device, to receive the image frame for determining the output frequency of the image frame, change the total of sustain pulses and display the image frame on the PDP, wherein the cycle number for each subfield is re-implemented, as the output frequency is lower than 50 Hz, by re-distributing the largest cycle numbers periodically in the input frame and the total of sustain pulses is a function of image loading.

To achieve the aims, the present invention also provides a second driving method for PDPs with variable vertical frequency, which adjusts a vertical frequency of a PDP and accordingly increases a total of sustain pulses by adjusting the number of subfields for the PDP, such that high brightness is obtained. The second driving method is provided for a PDP with a vertical frequency, and a total of sustain pulses and a first plurality of subfields. The second driving method includes inputting an input frame to the PDP and accordingly calculating an image loading value to change the vertical frequency to a new vertical frequency and to change the total of sustain pulses to a new total of sustain pulses, changing the first plurality of subfields to a second plurality of subfields according to the new vertical frequency, and displaying an output frame on the PDP according to the new vertical frequency, the new total of sustain pulses and the second plurality of subfields.

To comply with the first driving method, the invention also provides a driving apparatus for PDPS with variable vertical frequency. The driving apparatus connected to a PDP with a total of sustain pulses and multiple subfields, includes an input device to receive an input frame with an input frequency, a measurement device connected to the input device to measure an image loading value of the input frame and output the image loading value, a conversion device connected to the input device and the measurement device to receive the input frame with the input frequency and convert the input frame to an image frame with an output frequency for outputting the image frame, wherein the output frequency is a function of image loading and a second display control device connected to the conversion device and the measurement device to receive the image frame for determining the output frequency of the image frame, changing the total of sustain pulses, and displaying the image frame on the PDP, wherein the number of multiple subfields is reduced as the output frequency is lower than a predetermined low frequency and the total of sustain pulses is a function of image loading.

DESCRIPTION OF THE DRAWINGS

The present invention is described by way of exemplary embodiments, but not limitations, illustrated in the accompanying drawings in which like references denote similar elements, and in which:

FIG. 3 is an example table of FIG. 2 according to the first embodiment of the invention;

DETAILED DESCRIPTION OF THE INVENTION

First Embodiment

Figure 1:
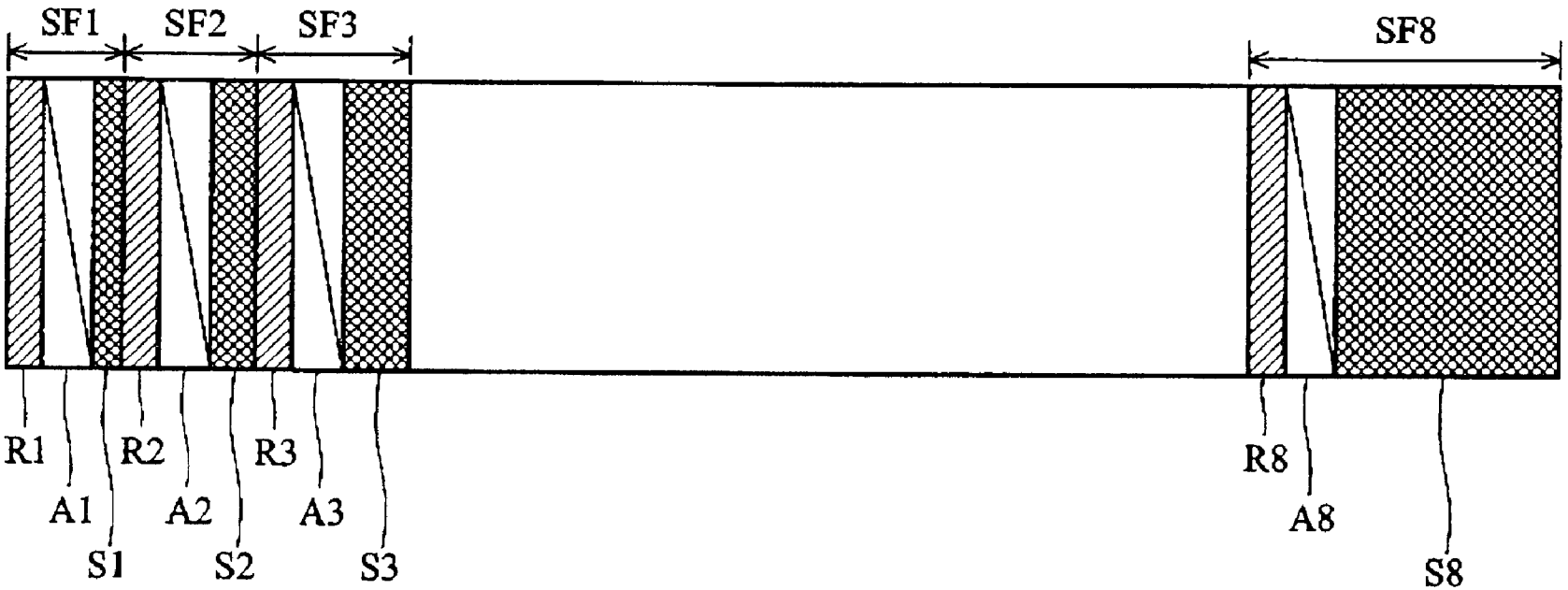
FIG. 1 is a schematic diagram of a frame display on a typical plasma display panel (PDP)
Figure 2:
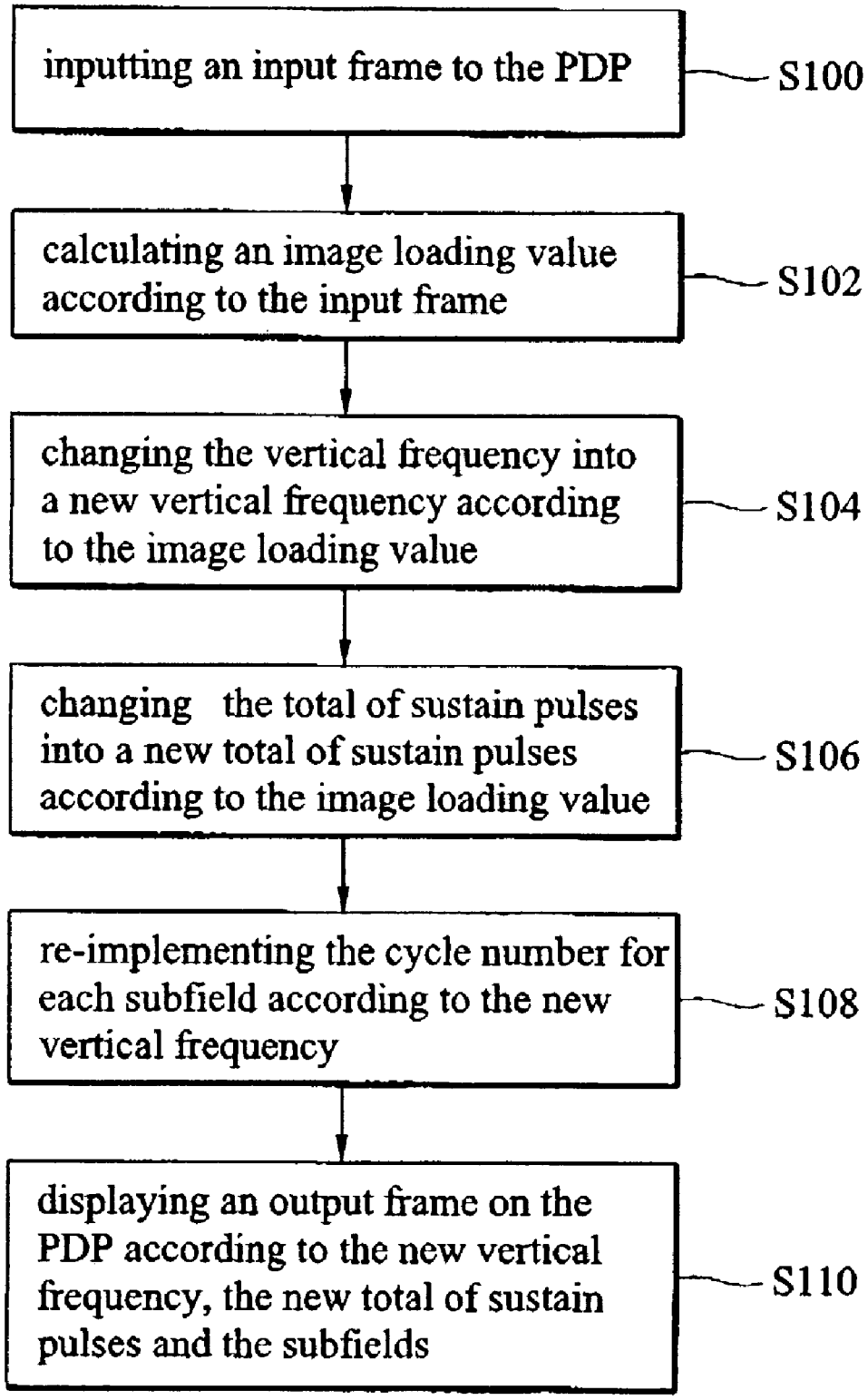
FIG. 2 is a flowchart of a driving method for PDPs with variable vertical frequency according to a first embodiment of the invention.

FIG. 2 is a flowchart of a driving method for PDPs with variable vertical frequency according to a first embodiment of the invention, As shown in FIG. 2, the driving method is provided for a PDP with a vertical frequency, and a total of sustain pulses and multiple subfields, each subfield containing a cycle number required for sustaining discharge. The inventive driving method includes inputting an input frame to the PDP (S100) and accordingly calculating an image loading value (S102) to change the vertical frequency to a new vertical frequency (S104) and to change the total of sustain pulses to a new total of sustain pulses (S106), re-implementing the cycle number for each subfield according to the new vertical frequency (S108), and displaying an output frame on the PDP according to the new vertical frequency, the new total of sustain pulses and the subfields (S110).

In step S104, the vertical frequency is higher with larger image loading value and the new vertical frequency is between 43–70 Hz. In step S106, the new total of sustain pulses is lower with larger image loading value and the new total of sustain pulses versus image loading value relation presents a simple curve. The step S108 further includes determining if the new vertical frequency is lower than 50 Hz, and, if so, re-implementing the cycle number for each subfield by re-distributing the largest cycle numbers periodically in the input frame.

FIG. 3 is an example table of FIG. 2 according to the first embodiment of the invention. In FIG. 3, the table is generated with the conditions having 10 subfields SF1–SF10 with a required cycle number of sustain pulses respectively to 1, 2, 4, 8, 16, 32, 48, 48, 48 and 48. For such a typical implementation, 10 subfields have totally 615 pulse numbers for each 6 μs. If current vertical frequency is 60 Hz and total peak brightness is 530 nits, peak brightness for each pulse is 0.8618 (530/615). After an input frame with vertical frequency 60 Hz is input, an image loading value of the input frame is calculated and the resulting value is bigger with higher brightness, i.e., more lighting pixels on the input frame. If the image loading value is low, i.e., the lighting pixel number on the input frame also is approximate to zero, the vertical frequency is changed from 60 Hz to 43 Hz according to the low image loading value. At this point, the display time for the input frame varies from 16.6667 ms to 23.2558 ms. The number of sustain pulses for the input frame increases (23.2558−16.6667) ms/6 μs=6589.1/6≈1098, i.e., new pulse number becomes 1713 (1098+615). The input frame accordingly adds 946.4087 nits (6.589 lms/6 μs*0.8618) brightness and the new peak brightness value for the input frame is 1476.4087 nits (946.4087+530) on brightness. A determination is performed to see if the new vertical frequency is lower than 50 Hz, before the input frame with new vertical frequency is output. In this case, the new 43 Hz frequency is lower than 50 Hz, the cycle number for sustaining discharge of each subfield required to be re-implemented. The resulting cycle number for re-implementation of the subfields is in the order of 48, 1, 2, 48, 4, 8, 48, 16, 32, 48, wherein the largest cycle numbers are re-distributed periodically in the input frame. With such a re-implementation, flicker possibly caused by low-frequency (in this case, 50 Hz) is eliminated. The input frame is then output according to the new vertical frequency, the new total sustain pulse-number and the subfields as an output frame on the PDP. Since the new peak brightness of 1058.093 nits (1476.4087*43/60) is much greater than the original peak brightness 530 nits, the invention thus substantially increases the brightness of the input frame.

Figure 4:
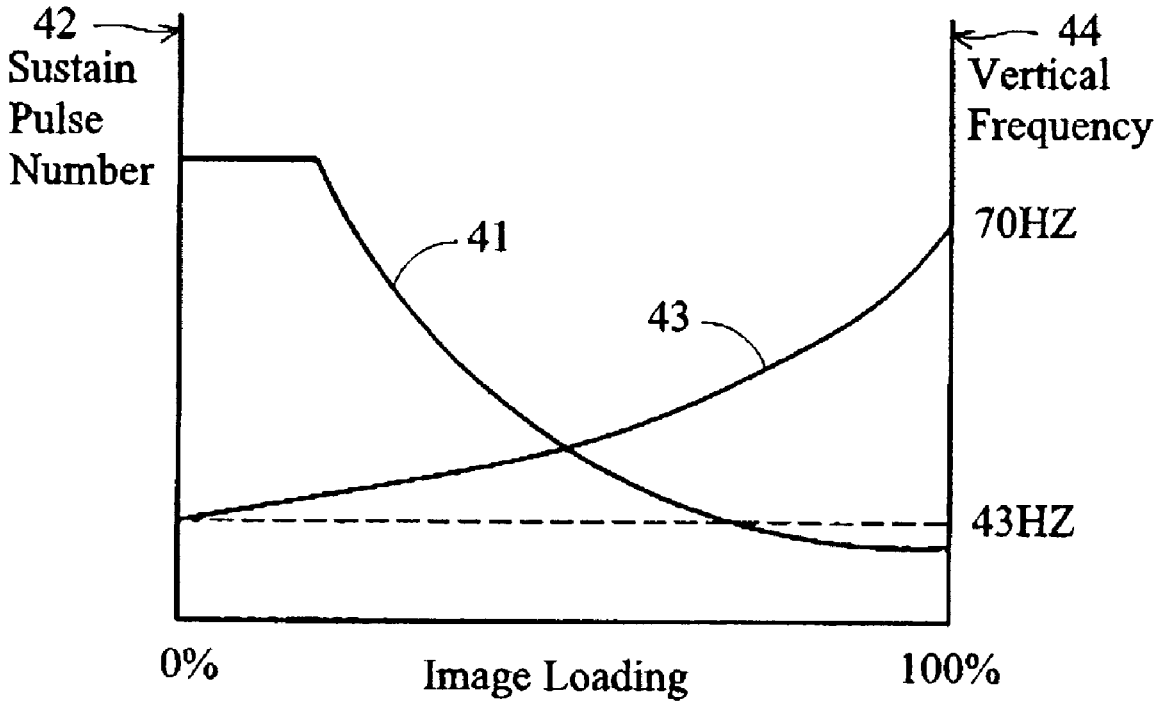
FIG. 4 shows curves of a sustain-pulse-number and vertical-frequency respectively of image-loading relation according to the first embodiment of the invention.

FIG. 4 shows curves of a sustain-pulse-number and vertical-frequency respectively to image-loading relation according to the first embodiment of the invention. In FIG. 4, a lateral axis represents image loading value from 0% to 100%, a first vertical axis 42 presents total sustain number (the total of sustain pulses) and a second vertical axis 44 presents vertical frequency in a unit of Hz. Curve 41 is a degressive curve of sustain number to image loading and curve 43 is an ingressive curve of vertical frequency to image loading. As shown in FIG. 4, the total sustain number decreases as the image loading value increases in curve 41 and the vertical frequency from 43 Hz to 70 Hz increases as the image loading value increases in curve 42.

Figure 5:
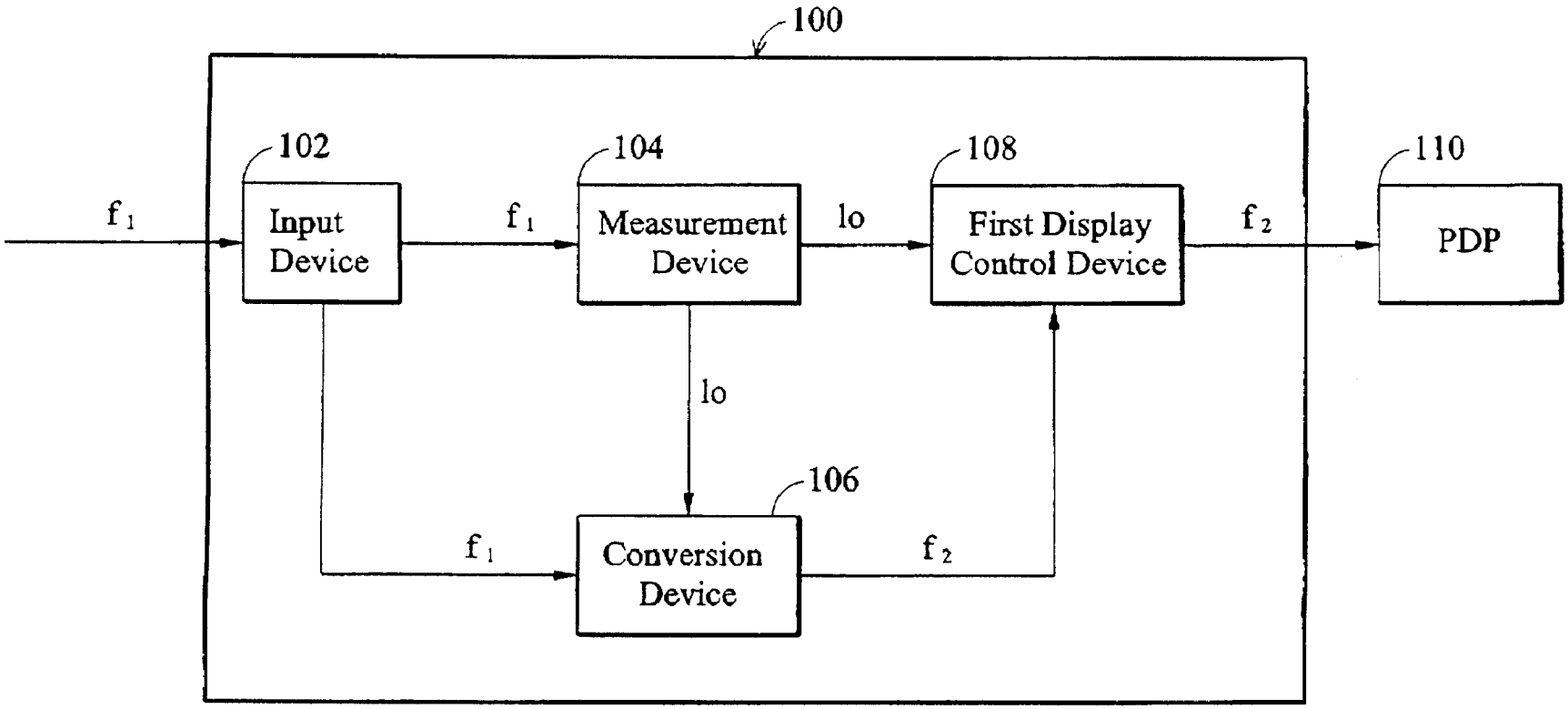
FIG. 5 is a schematic diagram of a driving apparatus according to the first embodiment of the invention.
Figure 6:
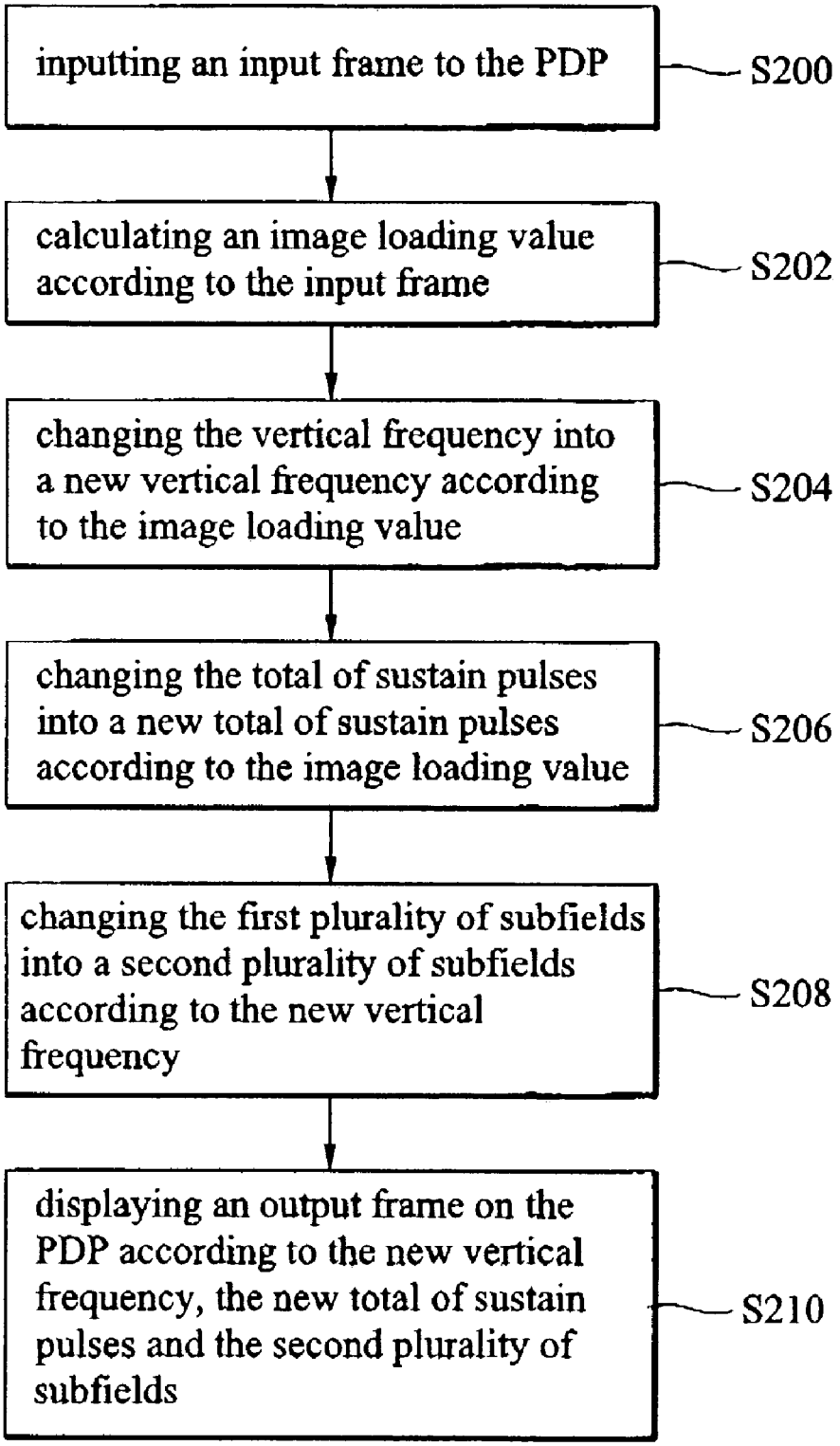
FIG. 6 is a flowchart of a driving method for PDPs with variable vertical frequency according to a second embodiment of the invention.

FIG. 5 is a schematic diagram of a driving apparatus according to the first embodiment of the invention. To comply with the driving method shown in FIG. 2, the invention provides a driving apparatus 100 connected to a PDP 110 with a total of sustain pulses and multiple subfields, each subfield containing a cycle number for sustaining discharge. The driving apparatus 100 includes: an input device 102 to receive an input frame with an input frequency $f_1$; a measurement device 104 connected to the input device 102, to measure an image loading value Io from the input frame and output the image loading value Io; a conversion device 106 connected to the input device 102 and the measurement device 104, to receive the input frame with the input frequency $f_1$ and convert the input frame to an image frame with an output frequency $f_2$ for outputting the image frame, wherein the output frequency $f_2$ is a function of image loading Io, and a first display control device 108 connected to the conversion device 104 and the measurement device 106 to receive the image frame for determining the output frequency $f_2$ of the image frame, change the total of sustain pulses and display the image frame on the. PDP 110, wherein the cycle number for each subfield is re-implemented, as the output frequency $f_2$ is lower than 50 Hz, by re-distributing the largest cycle numbers periodically in the input frame and the total of sustain pulses is a function of image loading Io, Second Embodiment FIG. 6 is a flowchart of a driving method for PDPs with variable vertical frequency according to a second embodiment of the invention. In FIG. 6, the second driving method for PDPs with variable vertical frequency is provided for a PDP with a vertical frequency, and a total of sustain pulses and a first plurality of subfields. As shown in FIG. 6, the second driving method includes inputting an input frame to the PDP (S200) and accordingly calculating an image loading value (S202) to change the vertical frequency to a new vertical frequency (S204) and to change the total of sustain pulses to a new total of sustain pulses (S206), changing the first plurality of subfields to a second plurality of subfields according to the new vertical frequency (S208), and displaying an output frame on the PDP according to the new vertical frequency, the new total of sustain pulses and the second plurality of subfields (S210).

In step S204, the vertical frequency is higher with larger image loading value and the new vertical frequency is between 43–70 Hz. In step S206, the new total of sustain pulses is lower with larger image loading value and the new total of sustain pulses versus image loading value relation presents a simple curve.

Step S208 further includes determining if the new vertical frequency is lower than a predetermined low frequency, and, if so, the subfield number is reduced. In the second embodiment, the predetermined low frequency is 55 Hz. That is, when the new vertical frequency is lower than 55 Hz, the subfield number is reduced by, for example, increasing the sustain time.

Figure 7:
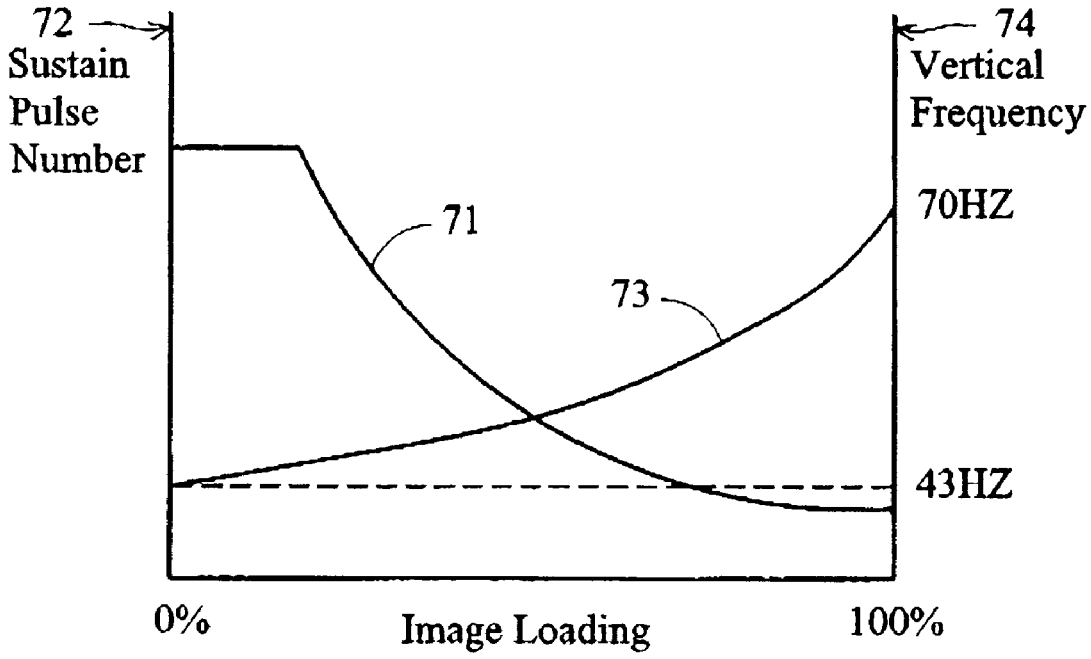
FIG. 7 shows curves of a sustain-pulse-number and vertical-frequency respectively to image-loading relation according to the second embodiment of the invention.

FIG. 7 shows curves of a sustain-pulse-number and vertical-frequency respectively to image-loading relation according to the second embodiment of the invention. In FIG. 7, a lateral axis represents image loading value from 0% to 100%, a first vertical axis 72 presents total sustain number (the total of sustain pulses) and a second vertical axis 74 represents vertical frequency Hz. Curve 71 is a degressive curve of sustain number to image loading and curve 73 is an ingressive curve of vertical frequency to image loading. As shown in FIG. 7, the total sustain number decreases as the image loading value increases in curve 71 and the vertical frequency from 43 Hz to 70 Hz increases as the image loading value increases in curve 72.

Figure 8:
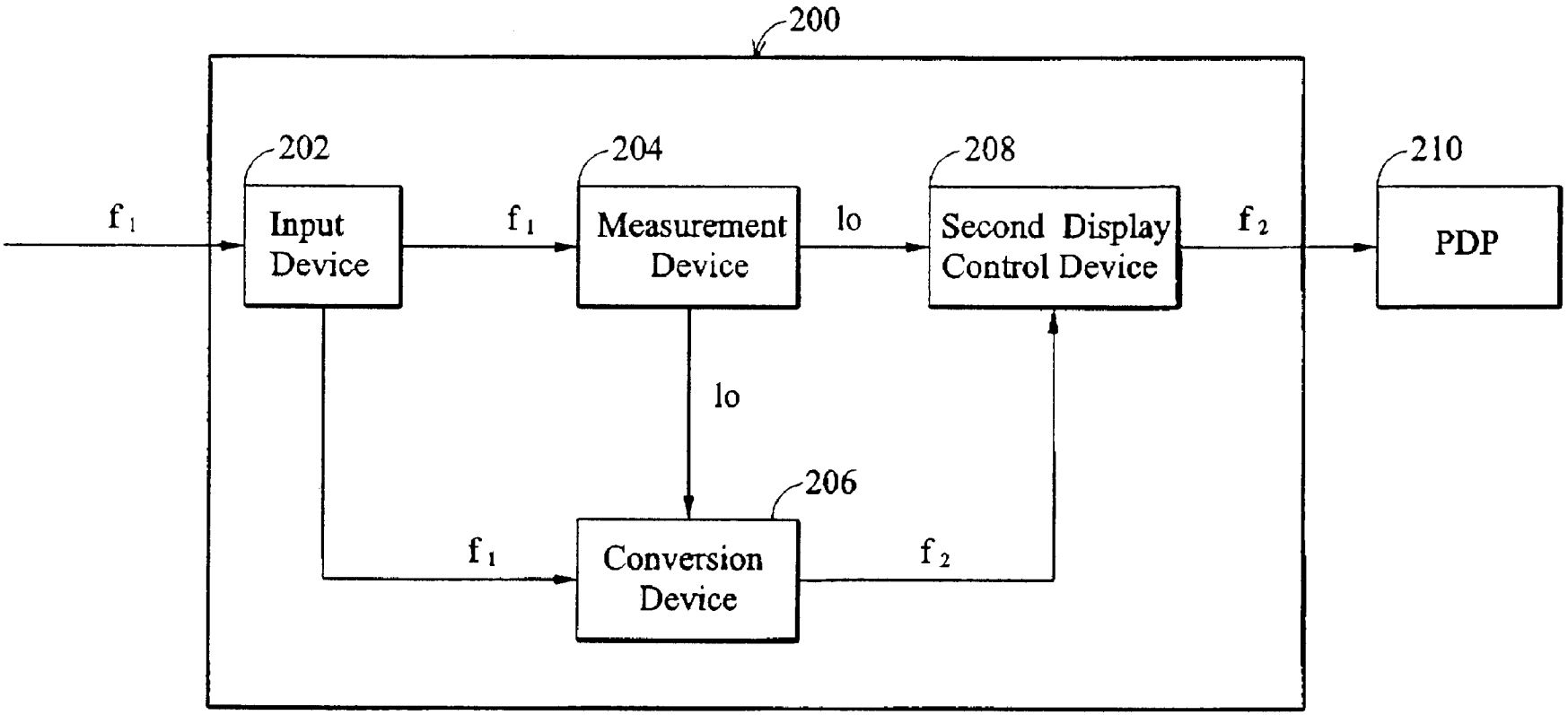
FIG. 8 is a schematic diagram of a driving apparatus according to the second embodiment of the invention.

FIG. 8 is a schematic diagram of a driving apparatus according to the second embodiment of the invention. To comply with the driving method shown in FIG. 6, the invention provides a driving apparatus 200 connected to a PDP 210 with a total of sustain pulses and multiple subfields, each subfield containing a cycle number for sustaining discharge. The driving apparatus 200 includes an input device 202 to receive an input frame with an input frequency $f_1$, a measurement device 204 connected to the input device 202,to measure an image loading value Io from the input frame and output the image loading value Io, a conversion device 206 connected to the input device 202 and the measurement device 204 to receive the input frame with the input frequency $f_1$ and convert the input frame to an image frame with an output frequency $f_2$ for outputting the image frame, wherein the output frequency $f_2$ is a function of image loading Io, and a second display control device 208 connected to the conversion device 204 and the measurement device 206 to receive the image frame for determining the output frequency $f_2$ of the image frame, change the total of sustain pulses and display the image frame on the PDP 210, wherein the subfield number is reduced, as the output frequency $f_2$ is lower than a predetermined low frequency and the total of sustain pulses is a function of image loading Io. In this embodiment, the predetermined low frequency is set to 55 Hz, but is not limited thereto.

Thus, the invention provides a driving method of increasing sustain time in the sustain period for PDPs. The driving method adjusts vertical frequency of a PDP through an image loading such that each image frame time displayed on the PDP is adjusted. The driving method also adjusts total sustain pulses in the PDP through the image loading. The inventive method accordingly increases the sum of the sustain periods to obtain high brightness on the PDP. To comply with the cited driving method, a driving apparatus for PDPs with variable vertical frequency is also provided.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A driving method for PDPs with variable vertical frequency, suitable for a PDP with a vertical frequency, and a total of sustain pulses and multiple subfields, each containing a cycle number required for sustaining discharge, the driving method comprising:

inputting an input frame to the PDP;

calculating an image loading value according to the input frame;

changing the vertical frequency to a new vertical frequency according to the image loading value;

changing the total of sustain pulses to a new total of sustain pulses according to the image loading value;

re-implementing the cycle number for each subfield according to the new vertical frequency; and displaying an output frame on the PDP according to the changed vertical frequency, the changed total of sustain pulses and the re-implemented subfields.

2. The driving method according to claim 1, wherein in the step of changing the vertical frequency to a new vertical frequency according to the image loading value, the new vertical frequency is higher with larger image loading value and is between 43 Hz and 70 Hz.

3. The driving method according to claim 1, wherein the step of re-implementing the cycle number for each subfield according to the new vertical frequency further comprises: determining if the new vertical frequency is lower than 50 Hz; and re-distributing the largest cycle numbers periodically in the input frame in order to re-implement the cycle number for each subfield when the new vertical frequency is lower than 50 Hz.

4. The driving method according to claim 1, wherein in the step of changing the total of sustain pulses to a new total of sustain pulses according to the image loading value, the new total of sustain pulses is lower with larger image loading value and the new total of sustain pulses versus image loading value relation presents a simple curve.

5. A driving apparatus for PDPs with variable vertical frequency, connected to a PDP with a total of sustain pulses and multiple subfields, each containing a cycle number required for sustaining discharge, the driving apparatus comprising:

an input device to receive an input frame with an input frequency;

a measurement device connected to the input device, to measure an image loading value from the input frame and output the image loading value;

a conversion device connected to the input device and the measurement device, to receive the input frame with the input frequency and convert the input frame to an image frame with an output frequency for outputting the image frame, wherein the output frequency is a function of image loading value; and a first display control device connected to the conversion device and the measurement device, to receive the image frame for determining the output frequency of the image frame, change the total of sustain pulses, and display the image frame on the PDP, wherein the cycle number for each subfield is re-implemented, as the output frequency is lower than 50 Hz, by re-distributing the largest cycle numbers periodically in the input frame and the total of sustain pulses is a function of image loading value.

6. A driving method for PDPs with variable vertical frequency, suitable for a PDP with a vertical frequency, and a total of sustain pulses and multiple subfields, the driving method comprising:

inputting an input frame to the PDP;

calculating an image loading value according to the input frame;

changing the vertical frequency to a new vertical frequency according to the image loading value;

changing the total of sustain pulses to a new total of sustain pulses according to the image loading value;

changing the first plurality of subfields to a second plurality of subfields according to the new vertical frequency; and displaying an output frame on the PDP according to the changed vertical frequency, the changed total of sustain pulses and the second plurality of subfields.

7. The driving method according to claim 6, wherein in the step of changing the vertical frequency to a new vertical frequency according to the image loading value, the new vertical frequency is higher with larger image loading value and is between 43 Hz and 70 Hz.

8. The driving method according to claim 6, wherein the step of re-implementing the cycle number for each subfield according to the new vertical frequency further comprises:

determining if the new vertical frequency is lower than a predetermined low frequency; and reducing a number of subfields when the new vertical frequency is lower than the predetermined low frequency.

9. The driving method according to claim 8, wherein the predetermined low frequency is 55 Hz.

10. The driving method according to claim 6, wherein in the step of changing the total of sustain pulses to a new total of sustain pulses according to the image loading value, the new total of sustain pulses is lower with larger image loading value and the new total of sustain pulses versus image loading value relation presents a simple curve.

11. A driving apparatus for PDPs with variable vertical frequency, connected to a PDP with a total of sustain pulses and multiple subfields, the driving apparatus comprising:

an input device to receive an input frame with an input frequency;

a measurement device connected to the input device, to measure an image loading value from the input frame and output the image loading value;

a conversion device connected to the input device and the measurement device, to receive the input frame with the input frequency and convert the input frame to an image frame with an output frequency for outputting the image frame, wherein the output frequency is a function of image loading value; and a display control device connected to the conversion device and the measurement device, to receive the image frame for determining the output frequency of the image frame, change the total of sustain pulses, and display the image frame on the PDP, wherein the number of multiple subfields is reduced as the output frequency is lower than a predetermined low frequency and the total of sustain pulses is a function of image loading value.

12. The driving apparatus according to claim 11, wherein the predetermined low frequency is 55 Hz.

13. The driving method according to claim 2, wherein the step of re-implementing the cycle number for each subfield according to the new vertical frequency further comprises:

determining if the new vertical frequency is lower than 50 Hz; and re-distributing the largest cycle numbers periodically in the input frame in order to re-implement the cycle number for each subfield when the new vertical frequency is lower than 50 Hz.

* * * * *